United States Patent [19]

Schriver et al.

[11] Patent Number: 4,864,654

[45] Date of Patent: Sep. 12, 1989

[54] PROTECTIVE HOOD JACKET RESISTANT TO TOXIC ENVIRONMENTS

[75] Inventors: John G. Schriver, Baltimore, Md.; William L. Riffel, Wilmington, Del.; John D. Scheible, Chestertown, Md.; Alan E. George, Dover, Del.

[73] Assignee: The United States of America as respresented by the Secretary of the Army, Washington, D.C.

[21] Appl. No.: 191,081

[22] Filed: May 6, 1988

[51] Int. Cl.[4] ..... A41D 13/00

[52] U.S. Cl. ..... 2/84; 2/69; 2/81; 2/424

[58] Field of Search ..... 2/84, 69, 81, 2.1 A, 2/2, DIG. 6, 424, 10

[56] References Cited

U.S. PATENT DOCUMENTS

| | | | |
|---|---|---|---|
| 2,709,667 | 5/1985 | Grubb et al. | 2/81 X |
| 2,982,105 | 5/1961 | Akers | 2/81 X |
| 2,994,089 | 8/1961 | Ferguson et al. | 2/81 |
| 3,132,344 | 5/1964 | Langdon | 2/84 X |
| 4,403,608 | 9/1983 | Warncke | 2/2.1 A X |
| 4,485,489 | 12/1984 | Pili,acu/e/ et al. | 2/2 |
| 4,577,348 | 3/1986 | Hoffmann | 2/84 |
| 4,677,696 | 7/1987 | Tanaka | 2/84 |
| 4,685,152 | 8/1987 | Heare | 2/84 X |

*Primary Examiner*—H. Hampton Hunter

*Attorney, Agent, or Firm*—Anthony T. Lane; Edward Goldberg; Edward F. Costigan

[57] ABSTRACT

A protective hood jacket adapted to be worn in combination with a protective suit in toxic environments comprises a hood jacket formed of heat-sealable material forming a garment that is hip length and short sleeved. There is a large hump in the rear to accommodate the air cylinder of a self-contained breathing apparatus and to avoid for forward bending. There is a combination closure in the back of the jacket consisting of a metal zipper and a CHLOROPEL zip-loc closure for donning/doffing an air bottle replacement. Vapor leakage is mechanically reduced by two types of seals. The first type encompasses the garment peripheries at the waist and sleeve ends and these seals incorporate cable draw strings and B-lock fasteners allowing for adjustment. The second type constitute internal collars, spaced above the end of the sleeves and waist and around the neck which include elastic webbing providing self-adjustability to fit small, medium and large size personnel. The elastic collar inside the hood, proximate the neck area, is designed to further reduce vapor infiltration to the head area and includes a frontal VELCRO closure which fastens around the BA mask inlet air tube.

10 Claims, 6 Drawing Sheets

PROTECTIVE HOOD JACKET RESISTANT TO TOXIC ENVIRONMENTS

The invention described herein may be manufactured, used and licensed by and for the Government for governmental purpose without the payment to us of any royalties thereon.

TECHNICAL FIELD

The present invention relates generally to apparatus for protecting workers from percutaneous poisoning in toxic environments. More particularly, the invention relates to a hood-jacket having an effective sealing system and which is adapted to be worn over self-contained breathing apparatus with or without a protective ensemble to enable the wearer to perform tasks within the toxic environment.

BACKGROUND ART

Various governmental and other agencies have a recognized requirement for self-contained breathing apparatus to support EOD, missile fuel handlers, firefighters, etc., in an oxygen deficient and sometimes toxic agent evironment. The breathing apparatus (hereinafter "BA") generally comprises an air cylinder or bottle strapped to the wearer's back. The cylinder supplies air to the wearer through a face mask connected thereto via a hose arrangement and regulator. The regulator is strapped to the wearer's waist and the hose arrangement extends upwardly from the regulator along the wearer's chest for connection to the face mask.

There are actually various commercially available BAs for civilian and military use and they may be somewhat physically different from each other although they are each generally designed with the aforesaid components to protect the wearer's respiratory system from toxic chemical vaporous atmospheres, such as those from toxic commercial chemicals as red fuming nitric acid (RFNA) and unsymmetrical dimethyl hydrazine (UDMH) and toxic chemical agents as VX, GB and GD.

However, the wearer is still subject to poisoning through the skin (i.e., percutaneous poisoning). In addition, the BA components are subject to attack by the chemicals such that deterioration and corrosion result. Furthermore, the wearer and their BA, once in any of the toxic chemical environments, becomes totally contaminated.

SUMMARY OF THE INVENTION

It is accordingly one object of the present invention to provide a protective garment in the form of a hood-jacket to protect those portions of the head and neck of the wearer, not covered by the BA mask, from percutaneous poisoning and to protect the BA proper from exposure to toxic agents or corrosive chemicals.

Another object of the invention is to provide a hood-jacket that can be easily worn as part of a protective ensemble, i.e., a rocket fuel handler's suit, rubber boots, rubber gloves, and M23A1 breathing apparatus and the hood-jacket.

Still a further object is to provide a hood-jacket design having an effective system of inexpensive and easily operated and therefore workable collar barriers and neck, arm and waist seals that will allow for maximum flexibility and movement of the wearers performing their tasks within the toxic environment.

Yet another object is to provide a hood-jacket designed to fit wearers of all sizes and which may also be a disposable throw-away item that may be reused a number of times in the same contaminated atmosphere before discarding.

A further object is to provide a unique combination of a hood-jacket configuration and internal seals including internal collar barriers which together achieve an extremely tight fit resulting in essentially no internal leakage.

These and other objects are realized in a preferred embodiment of this invention by a hood-jacket garment of hip length that may be short-sleeved with a large hump in the rear to accommodate the BA's air cylinder and to allow for forward bending. The hood-jacket is preferably formed of a heat sealable material and there is a combination closure in the back of the jacket for donning/doffing an air bottle replacement. Vapor leakage is mechanically reduced by two types of seals. The first type encompasses the garment peripheries at the hip and sleeve ends. The seals incorporate cable drawstrings and are adjustable. The second type is internal collars a spaced distance from the end of the sleeves and around the waist and neck. The elastic collars are self-adjustable and designed to fit small, medium and large size personnel.

In accordance with other features of the invention, there is an elastic collar inside the hood, in the neck area, designed to further reduce vapor infiltration to the head area. This collar preferably has a frontal VELCRO closure which fastens around the BA mask inlet air tube.

The main materials used for the jacket are preferably CHLOROPEL (chlorinated polyethylene) for the base garment and vinyl plastic for the visor. The combination closure in the back of the jacket preferably includes a metal zipper plus a CHLOROPEL zip-loc closure for donning/doffing and air bottle replacement.

A waist draw cord and a sleeve draw cord are the initial means of producing an air-tight seal. Waist collar barriers and sleeve collar barriers are secondary seals to prevent leakage in the jacket area. The waist, sleeve and neck collar barriers are made of a thinner CPE material, are heat sealed to the inside of the hood-jacket and have elastic webbing affixed to inner portions thereof which fits snug to those portions of the wearer's body. A neck collar barrier, which fits snug to the neck above the collar of the wearer's protective suit worn beneath, prevents any leakage in the jacket area from entering the hood.

In accordance with other features of the invention, the neck collar barrier has a split cone configuration in the center of the front portion of the barrier material. The purpose of the split cone is to provide a means of sealing around the air supply hose of the BA and the exhalation duct. The air hose extends from the waist area up to the air mask on the wearer's face. The exhalation duct hose extends from the mask down to the chest area of the hood-jacket. A seal is effected around the air hose and exhalation duct by the wrap-around cone seal and fastened in place by vertical and wrap-around hook and pile fasteners.

The inventive feature is the unique combination of the hood-jacket configuration and the internal seals, both cable draw cords and internal collar barriers, which together achieve an extremely tight fit resulting in essentially no internal leakage. The hood-jacket and BA are designed to be worn over protective rubber suits which are concurrently being used. There may be a very small amount of leakage, depending on the physical activity of the wearer, which may get past the draw cord and collar barrier seals of the waist and sleeves and into the torso area. But, if this occurs, it is contained between the outside of the protective suit, the inside of the jacket part of the garment, and the neck collar barrier. There is no wearer's skin exposed in this area and the neck collar barrier respectively prevents leakage into the hood area.

The hood-jacket can be made from butyl-coated cloth or modified resin-butyl cloth, the same materials used in the protective suits. However, these materials are not heat sealable. Therefore, if made from butyl-coated cloth, the cloth part must be sewn together and the needle holes strapped (i.e., covered) if made from modified resin-butyl cloth, the cloth pieces would have to be sewn together and then vulcanized. Both of these methods of assembly are much more expensive than the heat-sealing methods preferably for use to assemble the materials of the present hood-jacket invention.

Still other objects of the present invention will become readily apparent to those skilled in this art from the following description wherein there is shown and described a preferred embodiment of this invention simply by way of illustration of the best modes contemplated for carrying out the invention. As will be realized, the invention is capable of other embodiments, and its several details are capable of modifications in various obvious respects, all without departing from the invention. Accordingly, the drawing and description will be regarded as illustrative in nature and not as restrictive.

BRIEF DESCRIPTION OF THE DRAWING

FIG. 19 is a partial perspective side elevational view of the cone seal of FIG. 17.

DETAILED DESCRIPTION OF THE INVENTION

Figure 2:
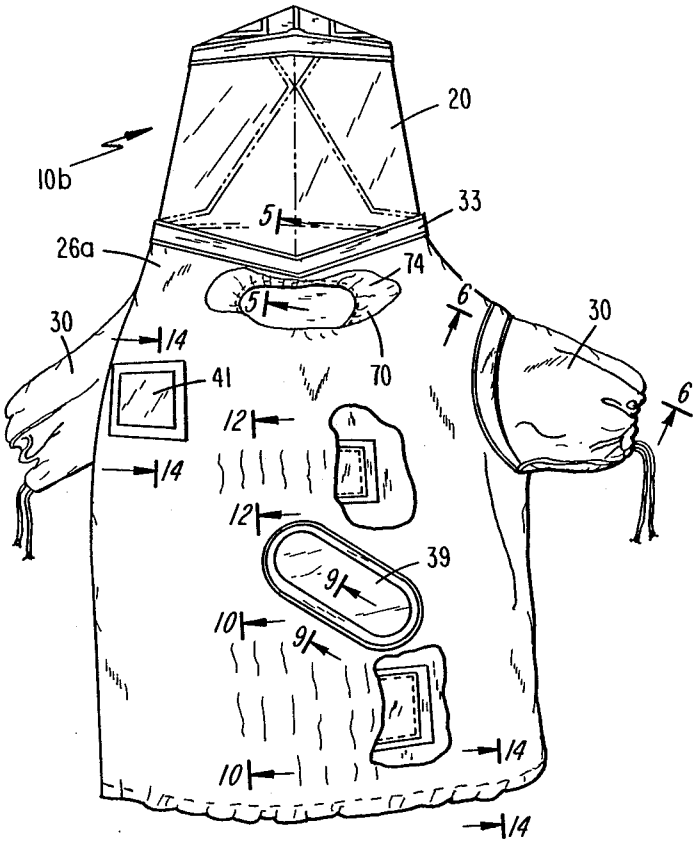
FIG. 2 is a front plan view of the hood-jacket of the present invention.
Figure 1:
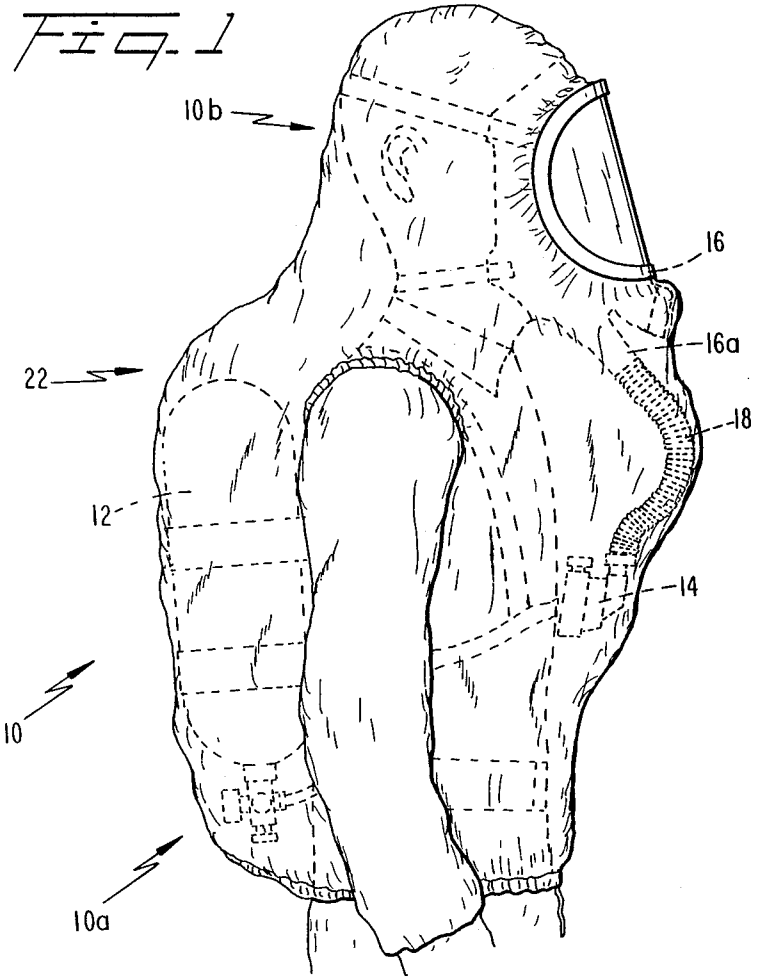
FIG. 1 is a perspective view of the hood-jacket of the present invention worn over a BA in combination with a rocket handler's or like suit worn beneath the hood-jacket.
Figure 3:
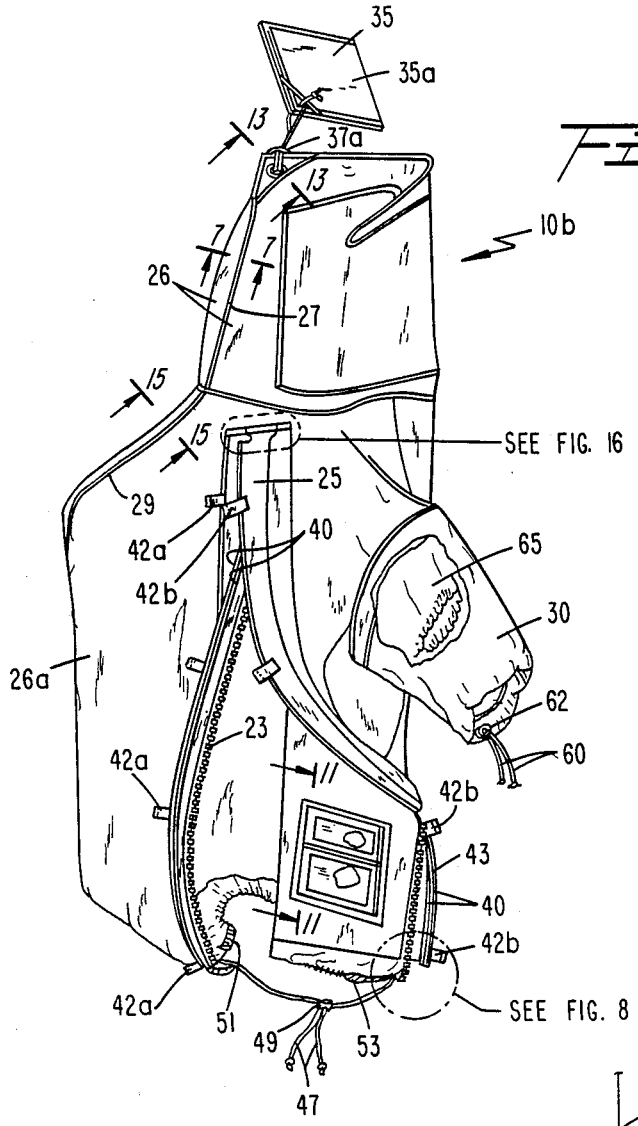
FIG. 3 is a rear plan view of the hood-jacket illustrating various primary and secondary seals of the jacket.

Reference is now made to FIGS. 1–3 wherein hood-jacket 10 is shown as being formed with a hood portion **10*b* and jacket portion 10*a* preferably made of panels of CHLOROPEL (chlorinated polyethylene) fabric heat-sealed together to form a single protective garment. Hood-jacket 10 as best illustrated in FIG. 1, is worn over a self-contained air supplied breathing apparatus (such as the M23A1 self-contained air supplied breathing apparatus) which breathing apparatus generally comprises an air cylinder 12 strapped to the wearer's back, a regulator assembly 14 having various instrument gauges (not shown in detail) strapped to the wearer's waist and a face mask 16 connected to regulator 14 with air hose 18 extending upwardly along the wearer's chest region for connection to an inlet valve 16*a* of the mask. As will be seen more fully below, hood-jacket 10 is designed to fit over the M23A1 type BA illustrated in the drawings as well as other BAs. Hood-jacket 10** is also designed to fit any wearer, regardless of size.

As will be seen more fully below hood-jacket 10 is preferably formed from panels of CHLOROPEL or other materials resistant to toxic chemicals, which panels may be heat-sealed together along their peripheries to form the base garment of the hood-jacket. A vinyl plastic material is used to form a visor 20 (FIG. 2) which is easily heat-sealed along its periphery to the fabric panels forming the hood portion **10*b*. The hood-jacket 10 is preferably of hip length and short-sleeved. There is a large hump 22 (FIG. 1) formed in the rear portion of the jacket 10*a* to accommodate air cylinder 12** of the BA and to allow for forward bending.

There is a combination closure in the back of jacket portion **10*a*, as best depicted in FIG. 3, comprising a metal zipper 23 and a CHLOROPEL zip-loc closure 25** for sealable opening and closing of the jacket portion rear for air bottle replacement in donning/doffing of the garment.

In addition to the foregoing seals 23, 25, vapor leakage is in general mechanically reduced by two types of seals within hood-jacket 10 of the invention. The first type, as will be seen below, encompasses the garment peripheries at the hip and sleeve ends. These seals incorporate cable draw strings and are adjustable. The second type constitute internal collars, a few inches up from the ends of the sleeves and around the waist and neck. These elastic collars are also self-adjustable. As will be seen below, the elastic collar inside the hood, in the neck area, is designed to further reduce vapor infiltration into the area. This collar has a frontal VELCRO closure which fastens around the BA mask inlet air tube.

Figure 5:
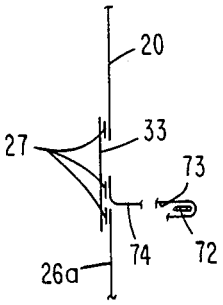
FIG. 5 is a sectional view taken along the line 5—5 of FIG. 2 to depict structural specifics of the neck collar barrier and the manner in which the visor is joined to the torso garment.
Figure 7:
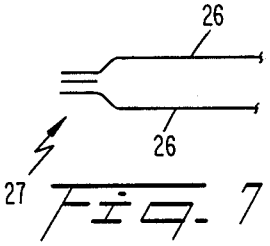
FIG. 7 is a sectional view taken along the line 7—7 of FIG. 3 to depict the manner in which fabric panels are sealed together to form the hood portion of the jacket.

As discussed above, hood portion **10*b* is that portion of hood-jacket 10 which is worn over the head. Hood portion 10*b* is preferably a combination of chlorinated polyethylene plastic material and, in particular fabric panels 26 thereof which may be heat-sealed together as at 27 (FIGS. 3 and 7). The panels 26 are also heat-sealed to visor 20 as depicted in FIGS. 2 and 5. Visor 20, such as polyvinyl chloride (PVC) of transparent optical quality, may constitute a major portion of hood 10*b*** to provide for optimum viewing conditions by the wearer.

Figure 15:
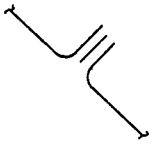
FIG. 15 is a sectional view taken along the line 15—15 of FIG. 3 to depict various specifics as to the manner in which fabric panels are secured together to form the jacket portion of the garment.

The torso or jacket portion **10*a* of hood-jacket 10 is also formed of chlorinated polyethylene fabric panels 26*a* that may be heat-sealed together at their peripheries (see FIGS. 3 and 15) as at 29 to form the basic jacket configuration. A pair of sleeves 30 also formed of chlorinated polyethylene heat-sealable plastic material are heat-sealed to the fabric panels 26*a* of jacket portion 10*a* (see, e.g., FIG. 6). The hood and jacket fabric panels 26,26*a* and visor 20 are then heat-sealed together as depicted in FIGS. 2 and 5 to form the basic outer garment of the hood-jacket. A chlorinated polyethylene fabric strip 33 (FIG. 5**) may be used to connect the hood or visor and jacket fabric panels together in heat-sealing relationship.

Figure 13:
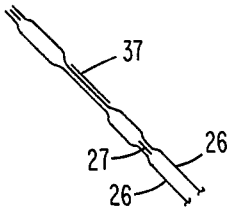
FIG. 13 is a sectional view taken along the line 13—13 of FIG. 3 to depict the manner in which an anti-fog kit may be secured to the hood portion of the garment.

An anti-fog kit schematically shown at 35 may be fixed to a portion of fabric panels 26 of hood **10*b* outside seal 27 as depicted in FIGS. 3 and 13. More specifically, anti-fog kit 35 is secured to a grommet 37 heat-sealed to fabric panel portions 26 atop the hood and secured thereto by string 37*a*. Anti-fog kit 35 consists of instructions, an anti-fog compound and a wiping cloth all enclosed in a plastic bag 35*a*. The compound is a medium hard wax-type substance that is applied like a crayon over the inner surface of visor 20 and gauge viewing windows 39 and 41** discussed infra. The compound is then rubbed with the fingers to cover the entire areas and the excess is removed by means of the wiping cloth. Its purpose is to reduce fogging of the inside of visor surfaces for clearer vision.

Figure 9:
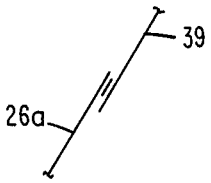
FIG. 9 is a sectional view taken along the line 9—9 of FIG. 2 to depict the manner in which the oval gauge window is secured to the jacket portion.
Figure 14:
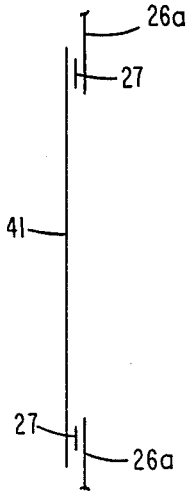
FIG. 14 is a sectional view taken along the line 14—14 of FIG. 2 to depict the manner in which a square instrument gauge window is fitted into the jacket portion of the garment.

Oval gauge window 39 and square gauge window 41 are both assembled in the front part of jacket portion **10*a*, as depicted in FIG. 2. Their function is to allow the user to view the front mounted pressure gauges forming part of regulator 14 of the BA worn beneath the hood-jacket 10. FIGS. 9 and 14 are respective illustrations as to the manner in which the gauge windows are secured to fabric panels 26*a*. It is to be noted that each window 39 and 41 is preferably made of the same PVC material as visor 20 and heat-sealed into the fabric panels 26*a*** of the jacket.

Figure 8:
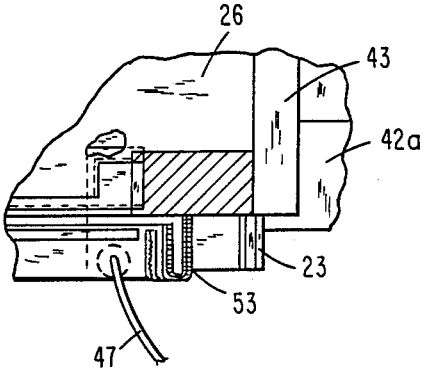
FIG. 8 is a sectional view taken along the line 8—8 of FIG. 3 to depict further structural specifics of the waist collar barrier and the closure means for the jacket portion of the hood-jacket.
Figure 16:
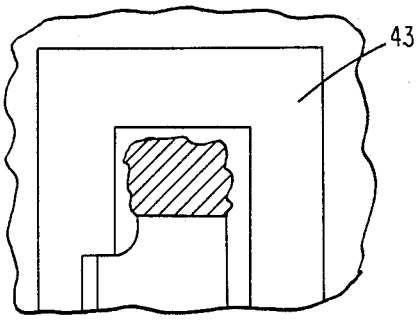
FIG. 16 is a sectional view taken along the line 16—16 of FIG. 3.
Figure 16:
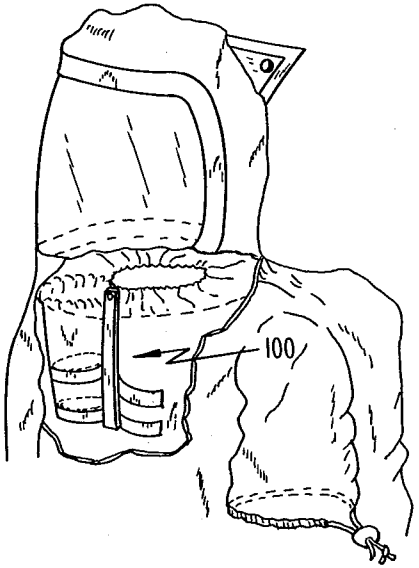

With reference now to FIGS. 3, 8 and 16, the combination closure 25 is heat-sealed in the rear of jacket portion **10*a* and comprises an inner metal zipper 23 and an outer double channel zip-loc plastic zipper (not shown in detail) 40 providing a good mechanical seal. The functions of zippers 23,40 are to establish an opening in the rear of jacket portion 10*a* on each half thereof for donning/doffing the hood-jacket 10 and for access to air cylinder 12 for replacement, without removing the garment. For a good air-tight seal, the two channels of zip-loc 40 are preferably filled with petroleum jelly on one side prior to donning. The zip-loc 40 may be opened by grasping adjacent pull tabs 42*a* and 42*b* starting at the bottom of the jacket to pull the zip-loc apart. The tabs 42*a*,42*b* are mounted on reinforcement fabric strips 43 which overlap fabric panels 26 to provide a one inch in width heat seal all around the closure opening (FIG. 3). The double plastic channels 40 of the zip-loc plastic zipper are fixed to these reinforcement panels as depicted in FIG. 3**.

Figure 4:
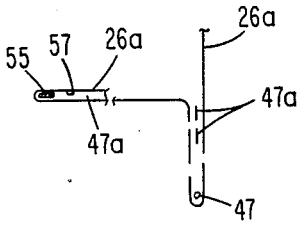
FIG. 4 is a sectional view taken along the line 4—4 of FIG. 2 to depict structural specifics of the waist collar barrier and draw cord.

With reference now to FIGS. 3 and 8, waist draw cord 47 is pulled tight to the waist of the wearer and held in place by a B-lock fastener 49. Waist collar barrier 50 is pulled snug about the waist higher than the draw cord 47 and fastened by means of hook and pile fasteners 51 and 53 sewn to the ends of the waist collar barrier. As depicted in FIGS. 4 and 8, the waist collar barrier is preferably formed by a piece of elastic webbing 55 positioned within a channel 57 formed by an overlapping piece of fabric panel **26*a* as depicted in FIG. 4. Waist draw cord 47 is also formed within a channel formed by overlapping a piece of fabric panel 26*a* and then heat-sealing the same together at 47*a* as depicted in FIG. 4**.

Figure 6:
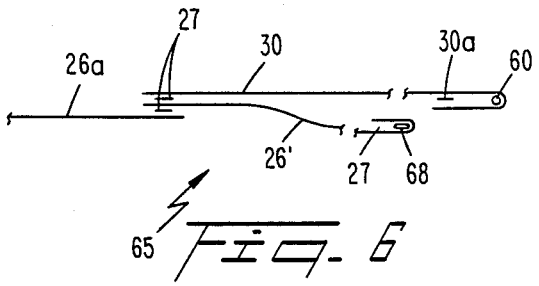
FIG. 6 is a view taken along the line 6—6 of FIG. 2 to depict structural specifics of the sleeve construction and associated sleeve draw cord and collar barrier seals.

Each sleeve 30 has a sleeve draw cord 60 which is pulled tight to the wearer's arms and fastened by means of a B-lock fastener 62 similar to the waist draw cord and fastener. FIG. 6 illustrates draw cord 60 as being located within a channel formed by overlapping a piece of the fabric sleeve over itself at the open end of the sleeve which is then heat-sealed together at **30*a*. Each sleeve 30 also has a sleeve collar barrier 65 therewithin as depicted in FIG. 3. The sleeve collar barrier 65 is preferably formed by means of a second fabric cylindrical panel 26' of chlorinated polyethylene material that has an outer end thereof doubled over and heat-sealed together at 27 to define a channel receiving elastic webbing 68 (FIG. 6). Elastic webbing 68** essentially forms the sleeve collar barriers inside the sleeves.

The neck collar barrier 70 discussed in more detail below is depicted in FIGS. 2 and 5 and is also defined by a piece of elastic webbing 72 received within a closed channel 73 formed in a chlorinated polyethylene length of material 74 having heat-sealed overlapping edges 27 which material is also heat-sealed to fabric panels **26*a*. The neck collar barrier 70 is thereby located inside hood-jacket 10 at the base of hood 10*b*** to effect a seal between the inside of the jacket area and the hood.

The waist draw cord 47 and the sleeve draw cord 60 are the initial means of producing an air-tight seal. The waist collar barrier and the sleeve collar barrier 65 are secondary seals to prevent leakage into the jacket area. The waist, sleeve and neck collar barriers are preferably made of a thinner chlorinated polyethylene material which are heat-sealed to the inside of the hood-jacket fabric panels **26,26*a* in the areas shown and have elastic webbing affixed to the inner portion which fits snug to those portions of the wearer's body. The neck collar barrier 70**, which fits snug to the neck above the collar of the wearer's protective suit worn beneath, prevents any leakage in the jacket area from entering the hood area.

Neck collar barrier 70 preferably includes a split cone configuration 100 in the center of the front portion of the barrier material. The purpose of the split cone 100 is to provide a means of sealing around the air supply hose 18 of the BA and the exhalation duct. The air hose 18 extends from the waist area up to the air mask 16 on the wearer's face. The exhalation duct hose (not shown) extends from the mask down into the chest area of the hood-jacket. A seal is effected around the air hose 18 and exhalation duct by the wrap around cone seal 100 and fastened in place by vertical and wrap around hook and pile fasteners.

More specifically, and with reference to FIGS. 17 and 18A–18C, the cone seal 100 is formed of neck collar barrier material (similar to the material forming collar 70) 102 folded into a cone shape having an upper diameter greater than the lower diameter. The cone seal 100 is open as at 104, the opening being defined by two edges 106A and 106B extending the entire length of the cone. A snap fastener having mating halves 108A and 108B are located at the top of each edge 106A and 106B, respectively, and hook and pile fastener strips 110 and 112 (e.g., Velcro) are secured on the inner vertical surface of seal material 102 adjacent the edges 106A and 106B. Tightening straps 114 having hook material 116 on one side and pile material 118 on the opposite side are vertically spaced from each other and secured to lower and middle portions of the cone seal.

Figure 18A:
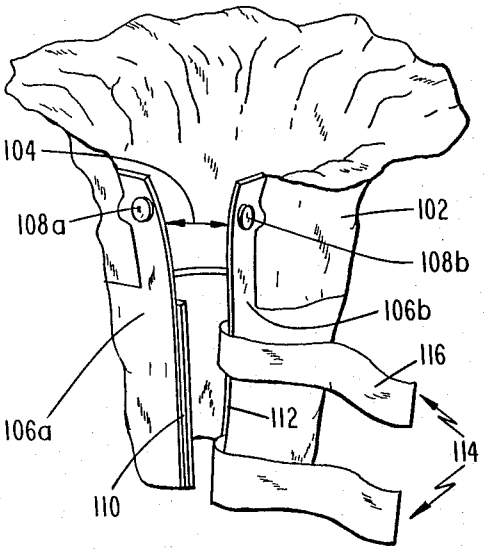
FIGS. 18A, 18B and 18C are partial perspective views of the cone seal configuration in open, partially closed and fully closed positions, respectively.
Figure 18B:
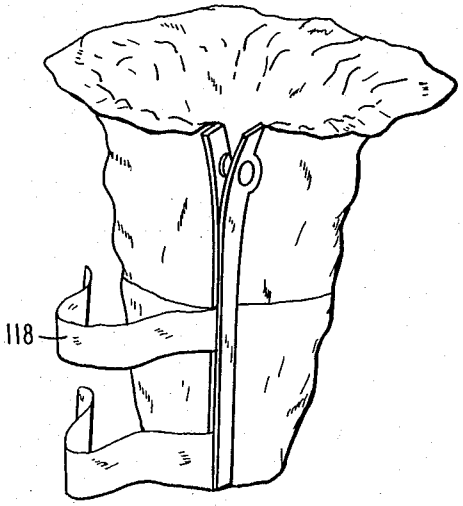
Figure 18C:
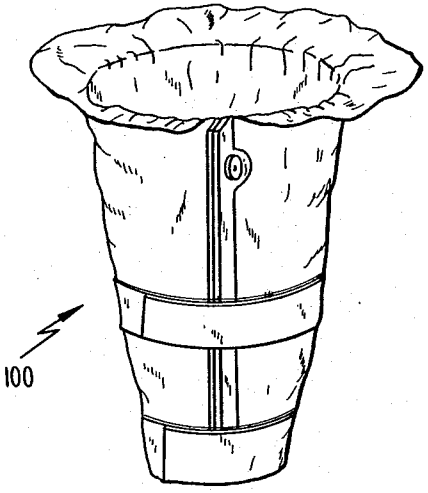

Once the air hose and exhalation duct are positioned through the center of the cone seal 100, the vertical sides or edges 106A and 106B are wrapped snugly around the air hose and exhalation duct and the open edges 106A and 106B are brought together. The inside vertical hook and pile straps 110 and 112 contact each other and hold the cone in the FIG. 18B position. The final closure and seal is effected by snapping the fastener halves 108A and 108B together and wrapping the two adjustment and tightening straps 114 around the cone. The length of the straps 116 is sufficient so that the hook surface 116 on one side of the cone will contact the pile surface 118 on the other side so that the cone seal is fully closed as depicted in FIG. 18C in sealing contact with the air hose and exhalation duct.

Figure 17:
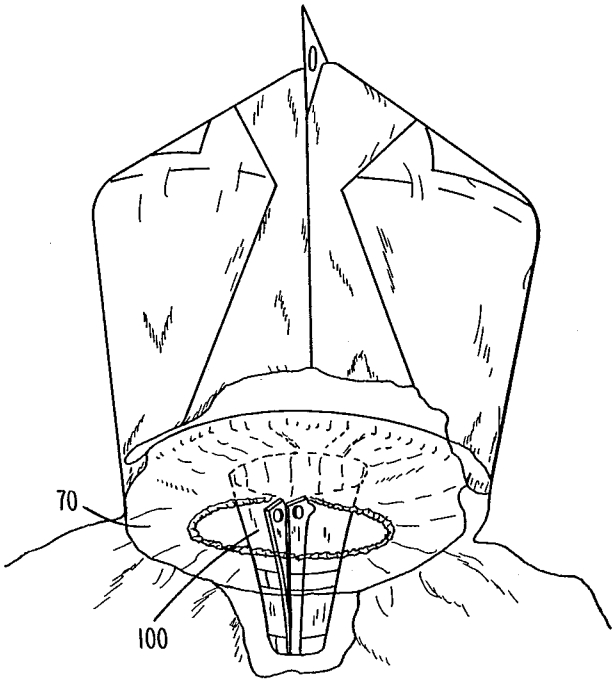
FIG. 17 is a partial perspective rear view of the interior of the hood portion depicting the neck collar barrier and cone seal configuration.

The next seal 100 is secured to neck collar barrier 70 such as with stitching along the upper edges of the cone material 102. The cone suspends freely below the neck collar barrier 70 as depicted in FIG. 17 and the partial side elevational view of FIG. 19.

Figure 10:
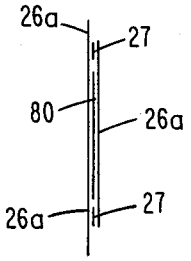
FIG. 10 is a sectional view taken along the line 10—10 of FIG. 2 to depict the manner in which elastic panels are secured to the jacket portion to provide a jacket having universal fit.
Figure 12:
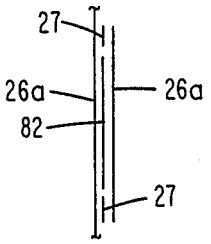
FIG. 12 is a sectional view taken along the line 12—12 of FIG. 2 to depict the manner in which another elastic panel is secured to the jacket portion.

In the front of jacket portion 10*a*, there are provided elastic webbing panels for compensators 80 and 82 as depicted in FIGS. 12 and 10, respectively. Compensators 80 and 82 are generally wide elastic pieces of webbings fastened into position while fully stretched and, once assembled, the compensators 80 and 82 contract which gathers the chlorinated polyethylene jacket material 26 together. The purpose of the gathers is to decrease excess space between the wearer's torso and the inside of the jacket portion which in reality decreases space that any leakage may accumulate in. The compensators 80,82 will expand according to the increase in size of the wearer to provide a self-adjustable feature as in the case of the four collar barriers.

Figure 11:
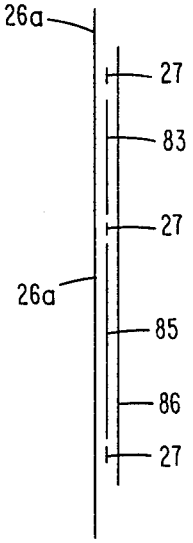
FIG. 11 is a sectional view taken along the line 11—11 of FIG. 3 to depict the manner in which a warning label and identification label are secured to the jacket portion.

Identification and warning labels 83 and 85, respectively, are covered by clear vinyl 86 heat-sealed at 27 to the inside of jacket 10*a* as depicted in FIGS. 3 and 11.

In accordance with the foregoing description, the inventive feature of hood-jacket 10 resides in the unique combination of the hood-jacket configuration and the internal seals, such as the cable draw cords and internal collar barriers which together achieve an extremely tight fit resulting in essentially no internal leakage. The hood-jacket 10 and BA are designed to be worn over protective rubber suits which are in current use. There may be a very small amount of leakage, depending on the physical activity of the wearer, which may get pass the draw cord and collar barrier seals of the waist and sleeves and into the torso area. However, if this occurs, it is contained between the outside of the protective suit and the inside of the jacket part of the garment and the neck collar barrier. There is no wearer's skin exposed in this area.

The hood-jacket may also be made from butyl-coated cloth or modified resin-butyl cloth, the same materials used in the protective suits. However, these materials are not heat-sealable. Thus, if made from butyl-coated cloth, the cloth parts must be sewn together and the needle holes strapped (covered). If made from modified resin-butyl cloth, the cloth pieces would have to be sewn together and then vulcanized. Both of these methods of assembly are generally much more expensive than the heat-sealing methods used to assemble the CPE materials of the present hood-jacket invention.

It should be apparent from the preceding that this invention may be practiced otherwise than as specifically described and disclosed herein. Modifications may therefor be made to these specific embodiments disclosed here without departing from the scope of this invention and such as intended to be included within the claims appended below.

What is claimed is:

1. A protective garment resistant to hostile environments consisting essentially of:

fabric means for defining a hood portion and a jacket portion sealed to each other to receive and protect, respectively, a wearer's head and torso from the hostile environment, said jacket portion including a pair of sleeves and a lower opening adapted to encircle the wearer's waist;

said fabric means includes a plurality of heat-sealable panels heat-sealed together and said hood contains a visor heat-sealed to said panels forming the hood portion;

means for adjustably sealing (1) the lower opening to the wearer's waist and (2) sleeve openings to the wearer's arms to resist the entry of toxic materials therethrough into the interior of the jacket portion;

said adjustable sealing means includes a waist draw cord and a B-lock fastener formed in the lower opening of the fabric means and a waist collar barrier formed in the lower opening of the fabric means above the waist draw cord, said waist collar barrier including elastic webbing for sealingly hugging the waist area, and hook and pile closure means for snugly securing the webbing in sealing position, and neck collar elastic barrier means located within the jacket portion for sealing contact with the wearer's neck region to prevent toxic materials from entering the interior of the hood portion through the interior of the jacket portion.

2. The garment of claim 1, further including sleeve collar barrier means and a draw cord located in the sleeve opening, said draw cord formed with a B-lock fastener for providing sealing between the sleeve opening and the wearer's arms, said sleeve collar barrier means including elastic webbing for providing further sealing contact with the wearer's arms.

3. The garment of claim 2, wherein said fabric means includes an opening formed in the area of the jacket portion to permit donning/doffing of the jacket by the wearer and means for selectively sealing portions of the fabric means defining said opening to each other for closing said opening, including a metal zipper in said fabric means defining said opening and zip-loc plastic channels providing a secondary sealing function in combination with said metal zipper.

4. The garment of claim 3, further including petroleum filling said zip-loc channels for maximum sealing effect.

5. The garment of claim 4, further including hook and pile closure tabs formed on opposite sides of the opening in spaced relationship along the length of said opening to maintain the zip-loc plastic channels in closed condition and to open said zip-loc channels to open the opening.

6. The garment of claim 5, wherein said neck collar barrier includes elastic webbing formed inside the jacket portion and spaced from fabric means forming the jacket portion by additional fabric means heat-sealed to the jacket portion.

7. The garment of claim 6, wherein said protective garment is adapted to be worn in combination with a self-contained breathing apparatus consisting of an air cylinder strapped to the wearer's back, a regulator and instrument gauges worn on the wearer's waist and a face mask connected to the regulator by means of a hose extending along the wearer's chest through the neck collar barrier into the hood portion, said fabric means being formed with a hump in the rear portion of the jacket to accomodate the air cylinder and to allow for forward bending of the wearer.

8. The garment of claim 7, wherein said neck collar barrier is formed with split cone barrier means in a front portion of said neck collar barrier to sealingly receive the hose.

9. The garment of claim 8, further including elastic webbing panels formed in the fabric means to define gathers in said jacket portion allowing for wearers of different size to wear said garment.

10. The garment of claim 9, further including gauge windows heat-sealed into said fabric means enabling said user to view instruments within the jacket interior associated with the regulator.

* * * * *